US005755597A

United States Patent [19]

Panis et al.

[11] Patent Number: 5,755,597

[45] Date of Patent: May 26, 1998

[54] ELECTRICAL CONNECTOR WITH A CONICAL WALL AND RING FOR ATTACHMENT OF A CABLE SHIELDING TO THE ELECTRICAL CONNECTOR

[75] Inventors: Werner Panis, Tessenderlo; Eddy Kamiel Creele, Dendermonde, both of Belgium

[73] Assignee: Framatome Connectors International, Courbevois, France

[21] Appl. No.: 627,451

[22] Filed: Apr. 4, 1996

[30] Foreign Application Priority Data

Apr. 5, 1995 [NL] Netherlands ..... 1000050

[51] Int. Cl.[6] ..... H01R 9/03

[52] U.S. Cl. ..... 439/610; 439/471

[58] Field of Search ..... 439/470, 610, 439/701, 471

[56] References Cited

U.S. PATENT DOCUMENTS

| | | | |
|---|---|---|---|
| 3,828,302 | 8/1974 | Cieniawa et al. | 339/91 R |
| 3,999,830 | 12/1976 | Herrmann, Jr. et al. | 439/610 |
| 4,125,312 | 11/1978 | Aimar | 439/470 |
| 4,280,746 | 7/1981 | Ignatowicz | 439/470 |
| 4,902,249 | 2/1990 | Morishita et al. | 439/610 |
| 5,358,428 | 10/1994 | Bixler et al. | 439/607 |
| 5,368,505 | 11/1994 | Hoolhorst et al. | 439/470 |

FOREIGN PATENT DOCUMENTS

| | | |
|---|---|---|
| 9214719.4 | 2/1993 | Germany . |
| 9309840.5 | 10/1993 | Germany . |
| 489510 | 8/1938 | United Kingdom . |

*Primary Examiner*—Neil Abrams
*Assistant Examiner*—Eugene G. Byrd
*Attorney, Agent, or Firm*—Perman & Green, LLP

[57] ABSTRACT

A connector for a cable with a plurality of conductors and a common shielding comprises a housing of insulating material with contacts to be connected with the conductors, and a metal hood. The housing is at least partially accommodated in the hood. The shielding of the cable can be connected to the hood and the metal hood is provided with a wall with a passage for the cable. This wall of the hood comprises an upright collar joining the passage and having a conical outer wall. A ring with a correspondingly conical inner wall can be attached on this wall of the hood while clamping the shielding of the cable between the conical outer wall of the collar and the conical inner wall of the ring.

5 Claims, 3 Drawing Sheets

ELECTRICAL CONNECTOR WITH A CONICAL WALL AND RING FOR ATTACHMENT OF A CABLE SHIELDING TO THE ELECTRICAL CONNECTOR

BACKGROUND OF THE INVENTION

The invention relates to a connector for a cable with a plurality of conductors and a common shielding, comprising a housing of insulating material with contacts to be connected with the conductors and a metal hood, the housing being at least partially accommodated in the hood, wherein the shielding of the cable can be connected to the hood and wherein the metal hood is provided with a wall with a passage for the cable.

In the known connector of this type the connection of the common shielding of the cable to the metal hood causes a problem. Generally a special tool is required to clamp an attachment part of the metal hood to the shielding by deformation.

The invention aims to provide a connector of the above-mentioned type, wherein an excellent connection between the shielding of the cable and the hood is guaranteed and no special tools are required.

SUMMARY OF THE INVENTION

To this end in the connector according to the invention said wall of the hood comprises an upright collar joining the passage and having a conical outer wall, wherein a ring with a correspondingly conical inner wall can be attached on said wall of the hood while clamping the shielding of the cable between the conical outer wall of the collar and the conical inner wall of the ring. Thereby a connector is obtained wherein the shielding extending along the full circumference of the cable can simply be placed on the conical outer wall of the collar whereafter the ring can be attached on the wall of the hood and the shielding can be clamped between the conical outer wall of the collar and the conical inner wall of the ring. The attachment of the ring on the hood may occur by means of screws.

BRIEF DESCRIPTION OF THE DRAWINGS

The invention will be further explained by reference to the drawings in which an embodiment of the connector is schematically shown.

DETAILED DESCRIPTION OF THE PREFERRED EMBODIMENT

Figure 1:
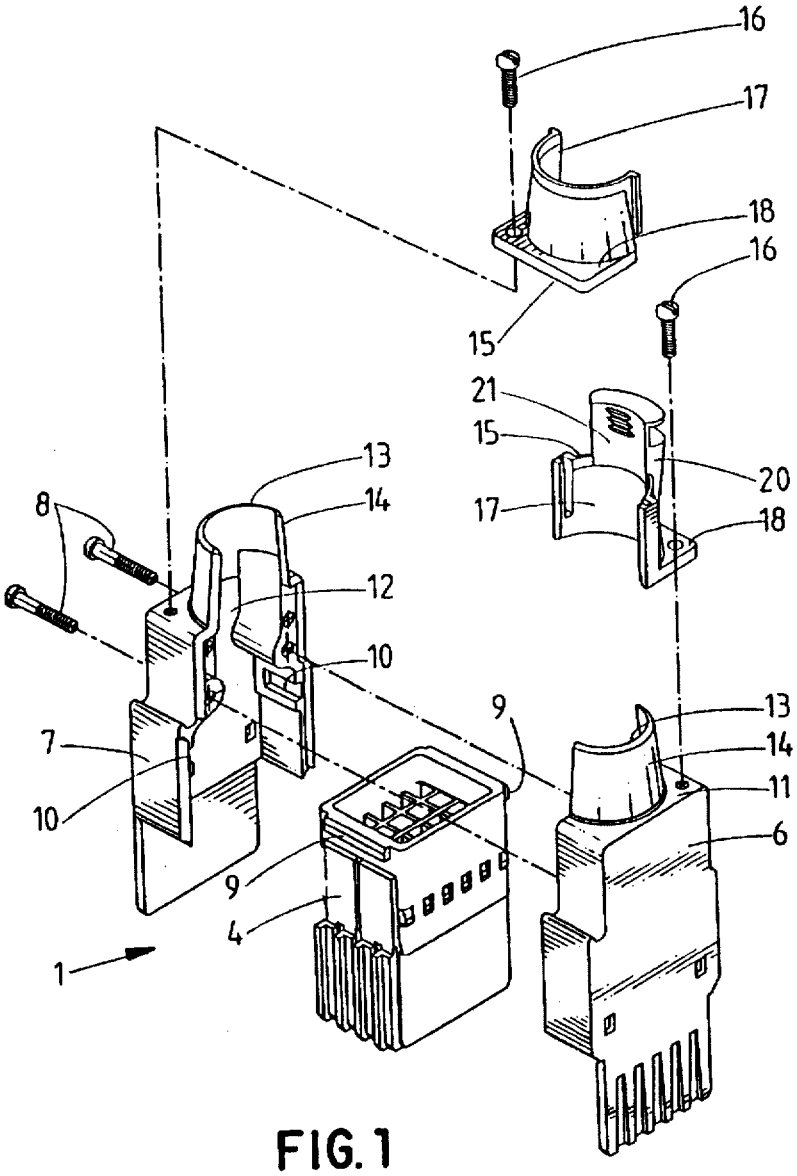
FIG. 1 shows an embodiment of the connector of the invention in exploded view.
Figure 2:
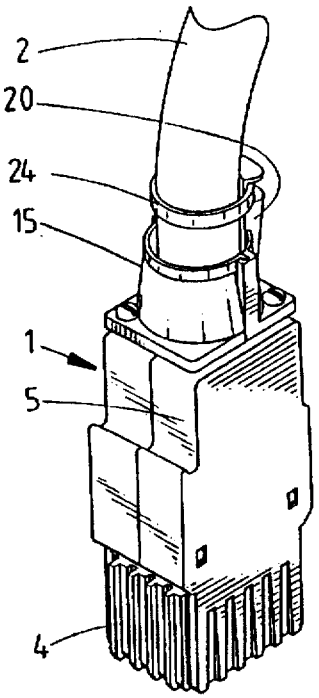
FIG. 2 shows the connector of FIG. 1 as assembled.
Figure 3:
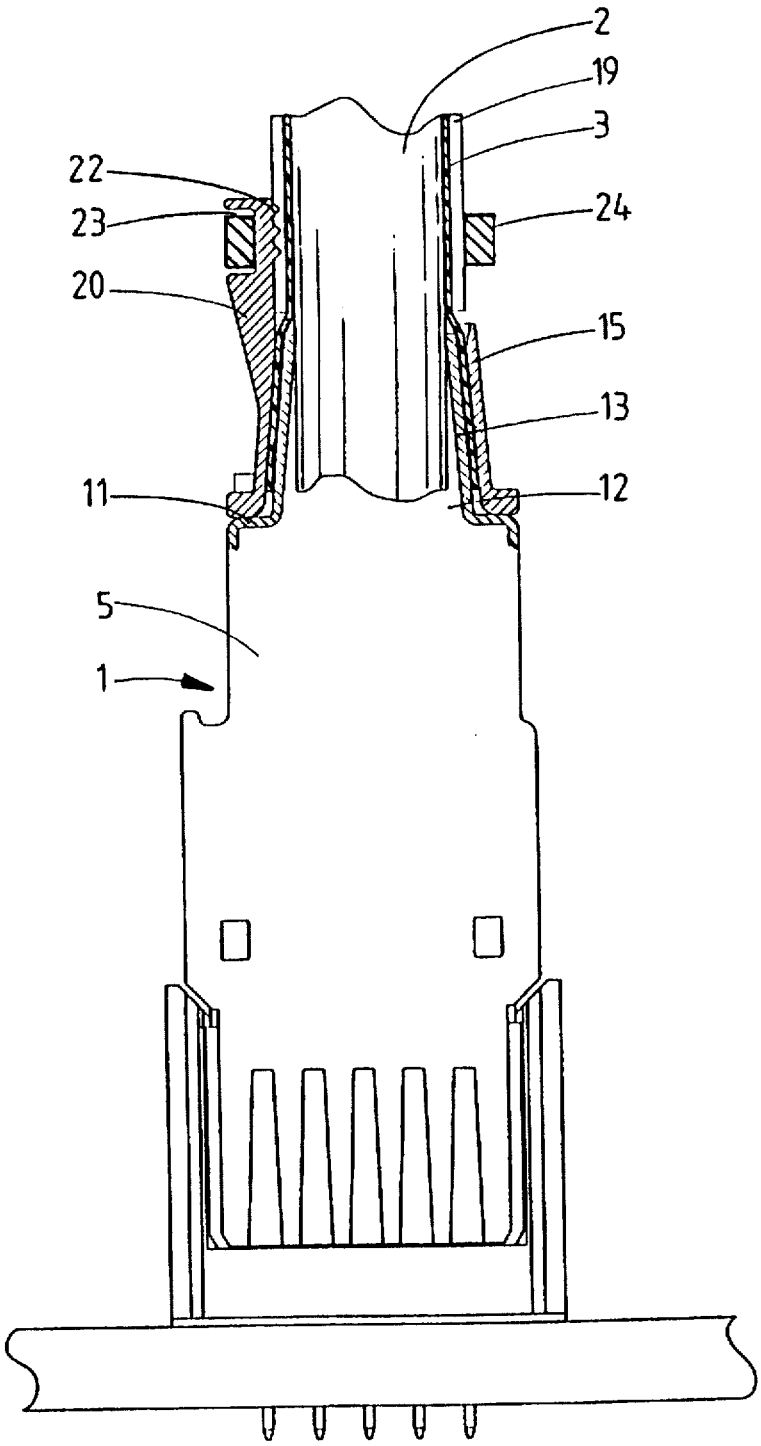
FIG. 3 is a schematically shown side view partially in cross-section of the connector of FIG. 1.

Referring to FIGS. 1–3 there is shown a connector 1 for a cable 2 with a plurality of conductors not further shown in the drawings and a common shielding 3 shown in FIG. 3. The connector 1 comprises a housing 4 of insulating material in which contacts are received not shown in the drawings, wherein the conductors can be connected with said contacts. Further, the connector comprises a metal hood 5 consisting of two parts 6 and 7 to be interconnected by screws 8. The housing 4 includes lugs 9 engaging into slots 10 of the hood parts 6, 7 to attach the housing in the hood.

The hood 5 comprises a passage 12 for the cable 2 in the upper wall 11 and this upper wall 11 comprises an upright collar 13 joining the passage 12 and having a conical outer wall 14. A ring 15 can be attached to the upper wall by means of screws 16, said ring 15 comprising a conical inner wall 17 accurately corresponding with the conical outer wall 14. The ring 15 has a mounting edge 18 and when this edge 18 rests upon the upper wall 11, the inner wall 17 of the ring 15 joins the conical outer wall 14 of the collar 13 substantially without any play.

As shown in the schematical cross-section of FIG. 3, the outer insulating jacket 19 of the cable 2 is removed in a usual manner and the shielding 3 is placed on the conical outer wall 14 of the collar 13. The cable is inserted through the passage 12 and the conductors are connected to the contacts of the housing 4 in a usual manner, so that it is not necessary to provide a detailed description of this process. When the shielding 3 is located on the conical outer wall 14, the ring 15 is attached to the upper wall 11 of the hood 5, whereby the shielding 3 of the cable 2 is clamped between the conical outer wall 14 and the conical inner wall 17. Thereby a connection along 360° between the shielding 3 and the hood 5 is guaranteed, wherein no special tools are required to establish this connection. Moreover, the hood 5 is suitable for different cable diameters as long as the cable can pass the passage 12. The contact between the shielding 3 and the collar 13 is provided along the complete area of the outer wall 14.

The ring 15 is provided with an extension 20 with an inner wall 21 providing a support for the cable 2. This inner wall has three ribs 22 in the embodiment shown, said ribs being adapted to penetrate into the insulating jacket 19 when the cable 2 is pressed against the inner wall 21. A slot is provided in the outer side of the extension 20 for receiving a clamping strip 24 by means of which the cable 2 is attached to the ring 15 and thereby to the hood 5. In this manner a strain relief of the cable 2 is obtained, which is fully independent of the connection of the shielding 3 with the hood 5.

Figure 4:
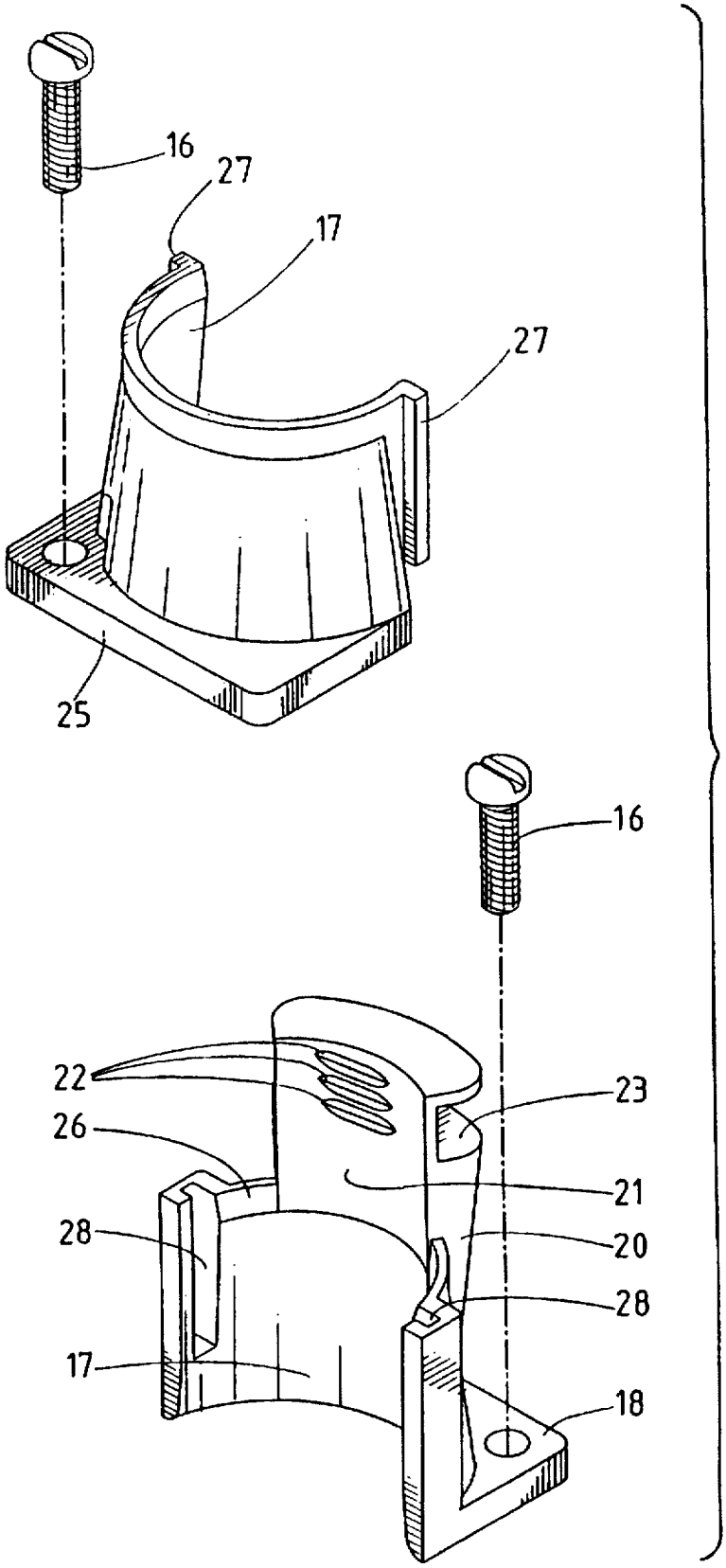
FIG. 4 shows the ring of the connector of FIG. 1 in exploded view at a larger scale.

The ring 15 shown at a larger scale in FIG. 4 comprises in the embodiment of FIGS. 1–3 two ring parts 25 and 26 which can be detachably interconnected. To this end the ring part 25 has two axially extending ribs 27 and the ring part 26 has two axially extending slots 28 for fittingly receiving the ribs 27.

However, it is also possible to make the ring 15 as one unitary part.

The invention is not restricted to the above-described embodiment which can be varied in a number of ways within the scope of the claims.

What is claimed is:

1. Connector for a cable with a plurality of conductors and a common shielding, comprising a housing of insulating material with contacts to be connected with the conductors and a metal hood, the housing being at least partially accommodated in the hood, wherein the shielding of the cable can be connected to the hood and wherein the metal hood is provided with a wall with a passage for the cable, wherein said wall of the hood comprises an upright collar joining the passage and having a conical outer wall, wherein a ring with a correspondingly conical inner wall can be attached on said wall of the hood while clamping the shielding of the cable between the conical outer wall of the collar and the conical inner wall of the ring.

2. Connector according to claim 1, wherein the ring is provided with an extension with an inner wall providing a support for the cable and with means for attaching a clamping strip adapted to press the cable on the support.

3. Connector according to claim 2, wherein the inner wall of the extension is provided with ribs adapted to at least partially penetrate into the insulating jacket of the cable.

4. Connector according to claim 1, wherein the ring is an assembly of two ring parts which can be detachably interconnected.

5. Connector according to claim 4, wherein one ring part has two axially extending slots and the other ring part has two axially extending ribs adapted to be fittingly received in a corresponding slot of said one ring part.

* * * * *